United States Patent [19]

Ilvespää et al.

[11] Patent Number: 5,022,163

[45] Date of Patent: Jun. 11, 1991

[54] METHOD AND DEVICE FOR DRAWING A WEB THROUGH A GROUP OF DRYING CYLINDERS

[75] Inventors: Heikki Ilvespää, Jyväskylä; Allan Liedes, Palokka; Olavi Viitanen, Jyväskylä, all of Finland

[73] Assignee: Valmet Paper Machinery Inc., Finland

[21] Appl. No.: 320,985

[22] Filed: Mar. 9, 1989

[30] Foreign Application Priority Data

Mar. 9, 1988 [FI] Finland ..... 881106

[51] Int. Cl.[5] ..... F26B 5/00

[52] U.S. Cl. ..... 34/23; 34/115; 162/370

[58] Field of Search ..... 34/113, 114, 115, 116, 34/117, 120, 23; 162/193, 370, DIG. 7; 68/DIG. 5; 15/306 A

[56] References Cited

U.S. PATENT DOCUMENTS 4,297,794 11/1981 Luthi ..... 34/115 X 4,483,083 11/1989 Chance ..... 34/113

FOREIGN PATENT DOCUMENTS 950296 2/1964 United Kingdom ..... 34/115

*Primary Examiner*—Henry A. Bennet

*Assistant Examiner*—John Sollecito

*Attorney, Agent, or Firm*—Steinberg & Raskin

[57] ABSTRACT

A method in a drying group or groups provided with a single-wire draw in a multi-cylinder dryer of a paper machine in the draw of a web. The multi-cylinder dryer comprises drying cylinders heated by means of steam or equivalent, with the web being pressed by a drying wire against the cylinder faces of these drying cylinders. The multi-cylinder dryer has leading or lower cylinders on which the web runs outside the drying wire which is, for example, a felt. The leading cylinders or rolls are provided with holes passing through a mantle of the leading cylinders or rolls, these holes being fitted to open into an inner space of negative pressure within the leading cylinder or roll and to open, at an opposite end, into grooves provided on a mantle face of the rolls. The negative pressure inside the roll is arranged to be transmitted to the grooves provided on the outer face of the roll mantle, so that an adhesion force is applied to the web through the grooves. In the method, a negative pressure is applied to the entire inside mantle face of the roll, and free flow of air is permitted through the holes from an area above the cylinder and into the interior space within the cylinder. The present invention further concerns a device for use in the single-wire draw of the multi-cylinder dryer of the paper machine, and also to a paper-machine cylinder itself.

10 Claims, 4 Drawing Sheets

METHOD AND DEVICE FOR DRAWING A WEB THROUGH A GROUP OF DRYING CYLINDERS

BACKGROUND OF THE INVENTION

The present invention concerns a method in a drying group or groups provided with a single-wire draw in a multi-cylinder dryer of a paper machine for supporting a web, the multi-cylinder dryer comprising drying cylinders heated by means of steam or equivalent, and the web being pressed by the drying wire directly against the cylinder faces of the drying cylinders. Furthermore, the multi-cylinder dryer comprises leading cylinders or rolls, on which the web remains outside of the drying wire.

Further, the present invention concerns a device which is applied in the area of a single-wire draw in a multi-cylinder dryer of a paper machine, this dryer comprising a line of heated drying cylinders, preferably upper cylinders, and a line of leading cylinders or rolls, the web running between these lines while being supported by a drying wire, e.g. a felt, so that the web is pressed by the drying wire on the heated drying cylinders into direct contact with the heated face of these drying cylinders, while the web is situated on an outer face of the drying wire over the leading cylinders or rolls.

The present invention also concerns a cylinder used in the draw of a paper web.

A problem in the case of leading rolls of single-wire groups in a drying section of a paper machine, has been making a paper web adhere to the wire on the lower face of the cylinder. On the lower cylinders or leading rolls, the web runs as a topmost layer, while the wire remains between the web and an outer face of the leading cylinder or roll. This problem does not occur in the case of the other rolls in a single-wire group, since the paper web runs between the wire and the mantle face of the cylinder.

Attempts have been made to solve this problem by utilizing suction rolls. A suction roll is quite expensive, with a suction box requiring inner sealing ribs which tend to become worn. When the sealing ribs operate dry, the wearing is even more extensive.

Negative pressure is applied through the suction box of a suction roll to a vacuum block inside the cylinder. This vacuum block is placed in a lower half of the cylinder in the case of the lower cylinders in a single-wire group. Through the negative pressure applied to this block, suction is expressly applied to a part of the cylinder face in which the paper web tends to become detached. Through bores in the mantle, negative pressure is applied through the felt to the paper web, which thereby adheres to the felt face.

A solution in the prior art for this problem of the paper web tending to become detached, is also known in which an arrangement in accordance with Valmet FI Pat. Appl. 851533 is used. In the noted Uno-Vac system, a type of suction box is used in which no wearing seals placed against the inner face of the roll mantle are used. In this solution, a high-velocity air flow is applied to the proximity of the edge of the suction box and the mobile mantle face. This air flow generates a suction flow from the interior of the box, which thereby prevents flow of air through the edge area in the opposite direction into the space of negative pressure. A negative pressure is applied to the interior of the suction box and is transferred through the bores in the mantle to the web face.

The high cost of construction of the equipment is considered a drawback of this solution. An abundance of holes must be made into the mantle. The inner axle requires flow ducts of its own, and suction ducts of its own.

The use of a suction box outside the mantle is also known in conjunction with single-wire groups. An outer face of the drying cylinder is provided with grooves, and the negative pressure is applied to these grooves through an outside suction box placed upon the cylinder. Thus, the negative pressure is transmitted through the grooves to a lower face of the cylinder, whereby a web holding force is thereby produced. This solution requires a great deal of space and the cost of construction is high.

SUMMARY OF THE INVENTION

Accordingly, it is an object of the present invention to eliminate the drawbacks of the prior art solutions noted above.

It is also an object of the present invention to provide an entirely new and improved paper machine cylinder, which is, in particular, suitable for use in supporting a web in conjunction with lower rolls in a single-wire group, i.e. in a drying section of a paper machine.

These and other objects are attained by the present invention which is directed to a method for guiding a web through a group of drying cylinders having at least one heated cylinder and having at least one leading cylinder or roll, with the web being passed around the cylinders. This method comprises the steps of providing the leading cylinder or roll with holes passing through a mantle thereof and fitting the holes in the mantle to open at one end into an interior space within the cylinder or roll mantle and at an opposite end into grooves provided upon an outer face of the mantle, and applying a negative or suction pressure to an inner face of the mantle to generate free flow of air into the cylinder or roll interior from an outer area surrounding the roll mantle through the holes. Thus, the negative or suction pressure is transmitted from inside the roll or cylinder to the grooves provided in the outer mantle face, while an adhesion force is applied to the web through the grooves.

In particular, the group of drying cylinders is situated in a multi-cylinder drying section of a paper machine and comprises a single-wire draw, whereby the web is pressed by a drying wire against a face of the at least one heated cylinder, and runs outside the drying wire about the at least one leading cylinder. The at least one heating cylinder is preferably heated by steam, while the drying wire is preferably a felt and the leading cylinder is a lower cylinder in the group of drying cylinders.

The present invention is also directed to a device for guiding a web through a group of drying cylinders having at least one heated cylinder and at least one leading cylinder or roll, with the web being passed around the respective cylinders. In particular, this device comprises the leading cylinder or roll being provided with holes passing through a mantle thereof and being fitted in the mantle to open at one end into an interior space within the cylinder or roll mantle, and at an opposite end into grooves provided upon an outer face of the mantle. Means are also provided for applying negative or suction pressure in the cylinder or roll interior, to generate free flow of air through the holes in the mantle and into the interior space. Thus, the negative or suction pressure is applied along an inner face of the cylinder or roll mantle, and is transferred from inside the roll or cylinder to the grooves, while an adhesion force is applied to the web through the grooves.

The group of cylinders is preferably situated in a multi-cylinder dryer section of a paper machine having a single-wire draw in turn having a drying wire arranged to press the web against a face of the heated cylinder and to pass the web outside of the drying wire and around the leading cylinder, while the means comprise a suction duct communicating with the interior of the cylinder or roll. The at least one heated cylinder is preferably heated by steam, while the at least one leading cylinder or roll is a lower cylinder in the group of drying cylinders, whereby the free flow of air is generated from an upper part of the cylinder or roll and from an area in which the wire and web are not pressed against the outer mantle face thereof.

Furthermore, the present invention is directed to a paper machine cylinder having shafts on which the cylinder is mounted to revolve by means of bearings, end flanges to which the shafts are respectively coupled, and a mantle connected to the flanges at ends thereof and having grooves on an outer face thereof. The cylinder has holes passing through the mantle and opening, at one end thereof, into these grooves and at an opposite end thereof, into an inner space within the mantle. The grooves are preferably fitted over substantially an entire width of the cylinder.

The method in accordance with the present invention is principally characterized by the leading cylinders or rolls being provided with holes passing through a mantle of the leading cylinders or rolls, these holes being fitted to open into an interior space of negative pressure in the respective leading cylinder or roll and, at an opposite end, to open into grooves in the mantle face of the rolls. Thus, the negative pressure inside the roll is arranged to be transmitted to the grooves provided in the outer face of the roll mantle, so that an adhesion force is applied to the web through the grooves. In this method, a negative pressure is applied to the entire inner mantle face of the roll, while free flow of air is permitted through the holes from an area, e.g., above the cylinder and into the interior space within the cylinder.

The device in accordance with the present invention in a drying group or groups provided with a single-wire draw in a multi-cylinder dryer of a paper machine for securing the draw of the web, is principally characterized by the leading cylinder being provided with holes passing through the mantle of the cylinder, these holes being fitted so that they open, at one end thereof, into the grooves provided in an outer face of the mantle of the cylinder and, at the other end thereof, open into the inner space of negative pressure in the cylinder. This device also comprises a source of negative pressure, from which negative pressure is applied through a suction duct to the inner space of negative pressure within the cylinder, whereby the negative pressure is applied at the same time to the entire inner face of the cylinder mantle so that, from an upper part of the cylinder, and from an area in which the wire and the web are not pressed against an outer face of the cylinder, free flow of air is permitted through the holes in the mantle of the cylinder and into the interior space within the cylinder.

The cylinder in accordance with the present invention is principally characterized by a grooved cylinder comprising a number of holes passing through a mantle and opening, at one end, into the grooves and opening, at the other end, into an inner space in the cylinder.

According to the present invention, a paper-machine cylinder of an entirely new type has been formed, which is especially well-suited as a lower cylinder or leading roll in a single-wire area in an initial part of a drying section of a paper machine. Centrifugal force and various blow phenomena attempt to detach a paper web from a wire off the face of the leading cylinder.

In the present invention, the starting point has been a basic fact that relatively little force is capable of keeping the paper web upon the wire face. According to the present invention, suction holes have been drilled into a grooved roll, these holes passing through the roll mantle to bottoms of grooves upon the roll. One end or both ends of the roll is/are provided with a shaft which comprises a suction duct, this suction duct being further connected to a source of suction, most appropriately to a centrifugal blower.

When the holes are appropriately dimensioned and when the roll mantle is provided with a certain limited number of bores that transmit the negative pressure, a permanent negative pressure can be generated in the interior of the roll. This negative pressure can be maintained in spite of the fact that a part of the holes in the roll open into the open air in the upper part of the roll. The effect of negative pressure is spread in the groove. In this manner, a band-shaped force pattern that attracts the web is obtained. By means of the negative pressure, the web is pulled towards the roll. The suction is applied to the web through the wire.

BRIEF DESCRIPTION OF THE DRAWINGS

The present invention will be described in greater detail below with reference to certain preferred embodiments illustrated in the accompanying figures, and to which, however, the present invention is not intended to be restricted. In the drawings.

DESCRIPTION OF THE PREFERRED EMBODIMENTS

Figure 1:
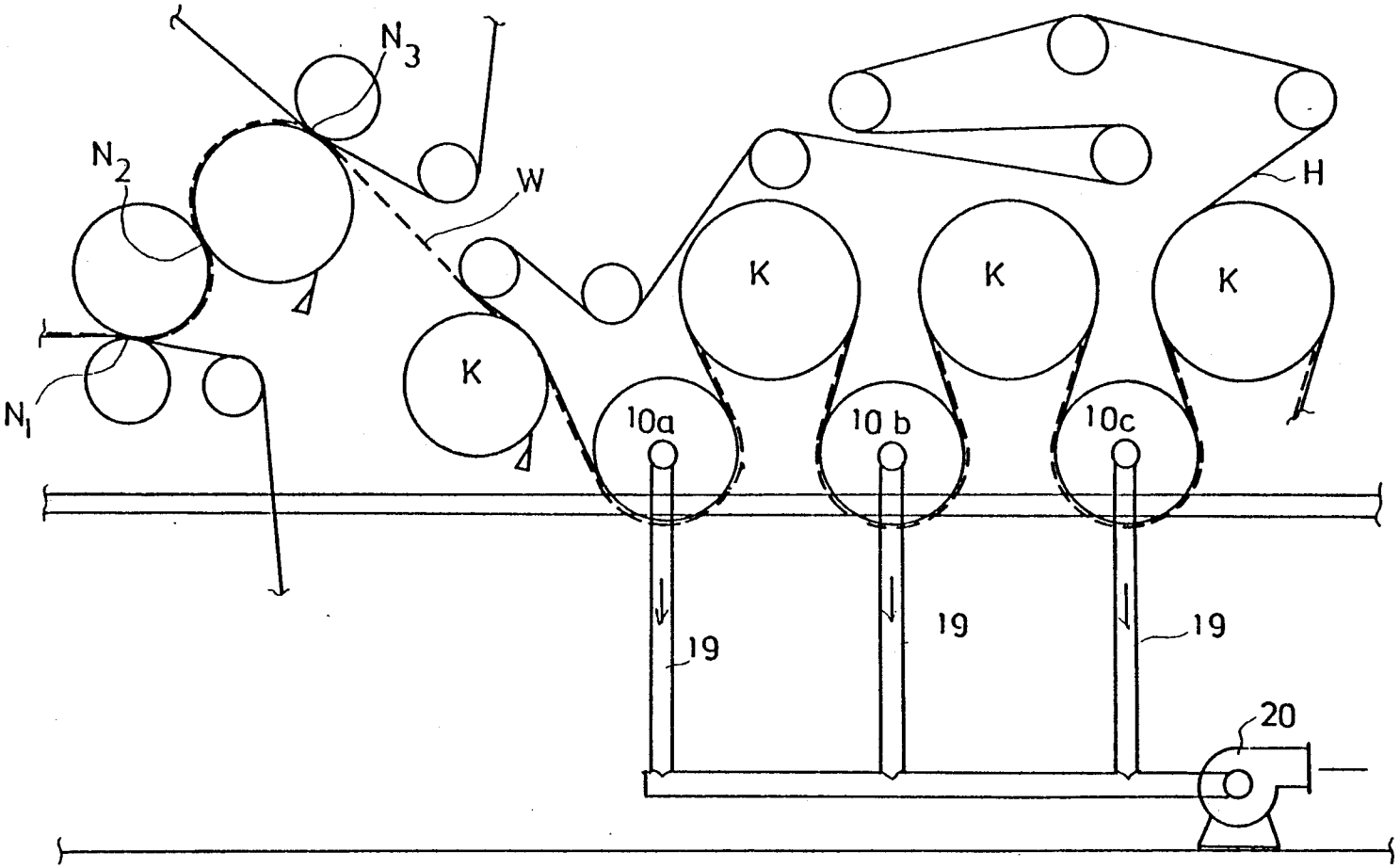
FIG. 1 is a schematic illustration of a Sym-Press II press and of an initial part of a drying section in a paper machine.

FIG. 1 illustrates the equipment utilized in accordance with the present invention. The area of single-wire draw in a multi-cylinder dryer of a paper machine is shown in FIG. 1. The dryer comprises a line of heated drying cylinders, preferably upper cylinders K, as well as a line of leading cylinders or leading rolls 10. The paper web W runs between these lines supported by a drying wire H, e.g. a felt. The web W runs on the heated drying cylinders K as pressed by the drying wire H. The drying wire H presses the web W into direct contact with the heated face of the drying cylinder K. At the leading cylinders or lower rolls 10, the web W runs on the outer face of the drying wire, e.g. felt H. In such a case, in the prior art solutions of equipment, there had been a major risk of the web W becoming detached from the face of the leading cylinders 10.

As shown in FIG. 1, the cylinders 10 in accordance with the present invention are situated as leading cylinders in the single-wire group of the paper machine. The web W is passed through the nips $N_1$ to $N_3$, to a first single-felt or single-wire group. In this group, the wire H is passed over the leading rolls 10*a*, 10*b*, and 10*c*. This single-felt draw, i.e. Uno-Run, runs the paper web W alternatingly between the wire H and the outer face of the drying cylinder K, while in the case of the leading cylinders 10 of the single-wire group, the wire H runs between the paper W and the outer face of the cylinder 10.

As is shown in FIG. 1, the paper machine leading cylinders 10*a*, 10*b* and 10*c* in accordance with the present invention are fitted as lower cylinders of the single-wire group. From a source 20 of negative pressure, advantageously from a centrifugal blower, negative pressure $P_1$ is applied through ducts 19 into an interior space in each of the cylinders 10*a*, 10*b* and 10*c*. The source 20 of negative pressure is fitted to be situated underneath the floor level of the paper machine, in the basement.

Figures 2A, 2B, 5:
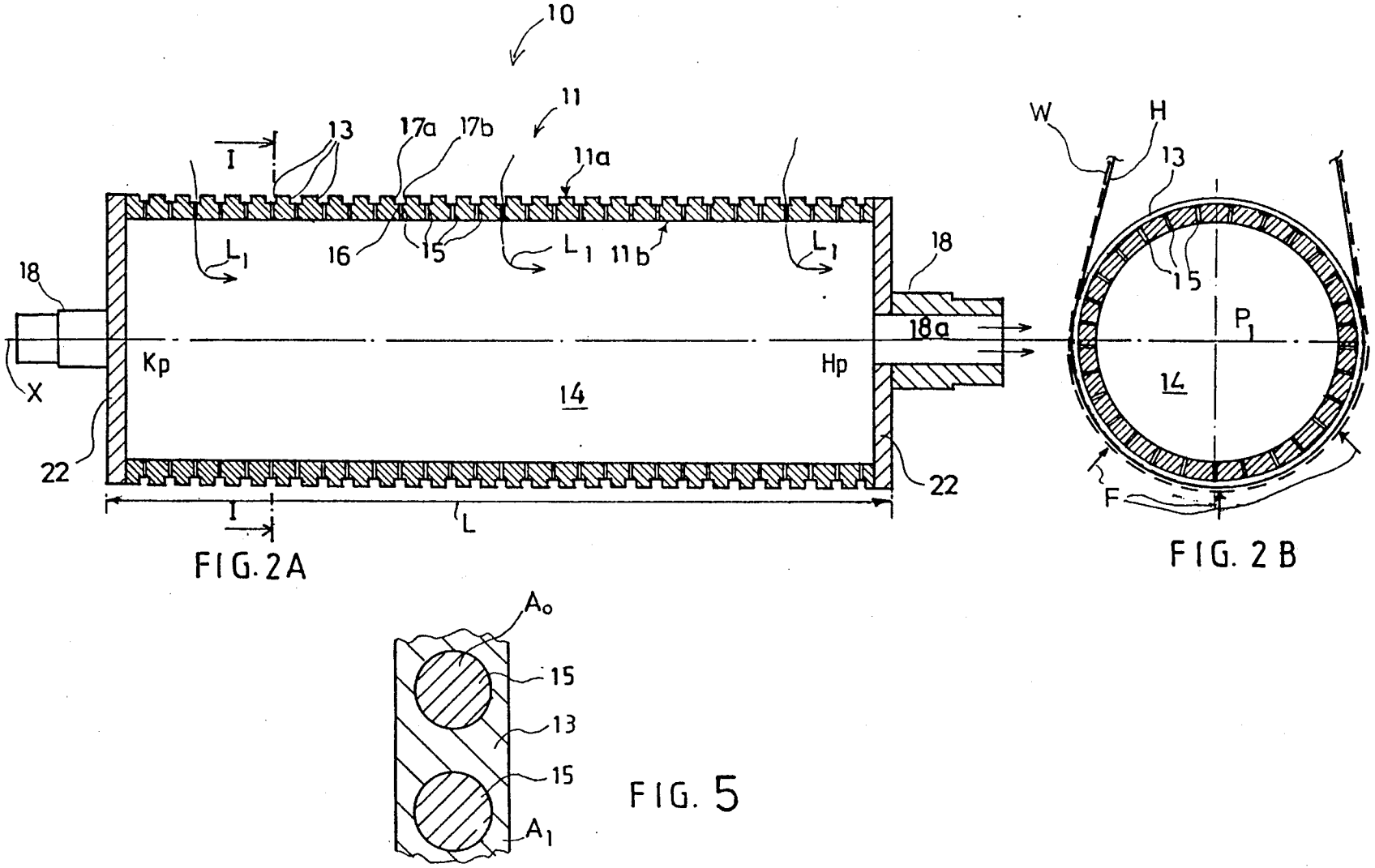
FIG. 2A illustrates a roll in accordance with the present invention and partially illustrates the principles of the present invention.
FIG. 2B is a sectional view along line I—I in FIG. 2A.
FIG. 5 illustrates cross-sectional area of a hole and cross-sectional area of a groove in accordance with the present invention.

FIGS. 2A and 2B illustrate the principles of the web draw and support arrangement in accordance with the present invention. The cylinder 10 is shown as a longitudinal sectional view in FIG. 2A. The cylinder 10 comprises a mantle 11 which is attached to the end flanges 22 of the cylinder. The outer face 11*a* of the cylinder 10 mantle 11 comprises grooves 13. The grooves 13 are closed annular grooves, which are situated side by side in the outer face 11*a* of the mantle 10 and in the area of the entire mantle. The groove 13 formation may also consist of one single groove 13 that runs spiral-shaped. In such a case the groove runs from one end of the mantle 10 to the other end. The grooves 13 are preferably turned into the mantle face, however an embodiment of the present invention is also possible in which a band that forms the grooves 13 is wound as spiral-shaped onto the outer face of the mantle frame. As used herein, the term "grooves" also refers to just a "single" spiral-shaped groove prepared as described above.

Negative pressure $P_1$ is applied to a space 14 of negative pressure within the cylinder 10 from the source 20 of negative pressure, e.g. from a centrifugal blower. The negative pressure is transmitted from the space 14 of negative pressure into the cylinder 10 through holes, preferably bores 15, into the grooves 13.

The holes 15 pass perpendicularly to a central axis X—X of the cylinder 10. Each hole 15 opens from one of its ends into the space 14 of negative pressure within the cylinder 10, and opens from the other end into a bottom 16 of the groove 13. The negative pressure is transmitted through the bores 15 substantially across the entire width L of the cylinder 10.

The grooves 13 comprise a groove bottom 16 and sidewalls 17*a*, 17*b*. Each hole 15 opens into the groove bottom 16. The holes 15 are uniformly spaced in the groove 13. The cylindrical space 14 of negative pressure inside the cylinder mantle 11 is substantially free from any constructions or components, and the negative pressure $P_1$ is applied to the entire inside mantle face 11*b* of the cylinder 10.

The cylinder 10 comprises shafts 18 on which the cylinder 10 is rotatably journalled. At least one of the shafts 18, the service-side Hp shaft as shown in FIG. 2A, includes a duct 18*a* through which negative pressure is applied to the space 14 of negative pressure situated inside the cylinder 10. The service-side shaft 18 is a tubular hollow shaft and communicates with the suction duct 19 from the source 20 of negative pressure, preferably from a centrifugal blower. Reference character $K_p$ denote the driving side of the paper machine.

FIG. 2B illustrates a sectional view along line I—I of FIG. 2A. FIG. 2B also shows the runs of the paper web W and of the wire H at a leading cylinder of a single-wire group, e.g. a single-felt group. The cylinder 10 comprises several holes ending in the groove 13, preferably bores 15. The bores 15 are fitted as uniformly spaced in the cylinder mantle 11. Negative pressure $P_1$ is introduced into the space 14 inside the cylinder 10, from the source 20 of negative pressure, and the negative pressure is applied to prevail under all circumstances of operation in the interior space 14 within the drying cylinder 10. The negative pressure $P_1$ is applied to the entire inner face 11*b* of the mantle 11 of the drying cylinder 10.

As shown in FIG. 2B, a holding force F is applied to the web W, this force F causing the web W to adhere to the face of the wire H of good permeability to air, e.g. of fabric, and thereby to the outer face 11*a* of the drying cylinder 10. Detachment of the web W from the cylinder 10 is thereby prevented. As shown in FIG. 2B, the upper face of the cylinder 10 remains free of the wire H and the web W. An unhindered flow of air is directed through this free face into the interior space 14 in the drying cylinder 10. The negative pressure $P_1$ tends to be reduced thereat. However, in accordance with the present invention, dimensioning of the cross sectional flow areas of the grooves 13 and of the holes 15 have been achieved so that the negative pressure can be maintained within the interior space 14 within the cylinder 10, in spite of this free flow of air $L_1$.

According to the present invention, the bores 15 are dimensioned so that the desired flow of air Q into the cylinder 10 and the desired negative pressure $P_1$ in the interior 14 of the cylinder 10 are achieved. A relatively low negative pressure $P_1$ is capable of maintaining the web W on the face of the wire H. The effect of this negative pressure is spread in the groove 13, and thereby a band-shaped force pattern in obtained that retains the web.

According to the present invention, by dimensioning each hole 15 so that its diameter has a suitable dimension and providing only a certain limited number of holes 15 in each groove 13, the air flow Q into the interior space 14 in the cylinder 10 is kept limited. A certain holding force is maintained as the starting point, this force being further achieved by means of a certain negative pressure $P_1$. This negative pressure $P_1$ is transferred through the holes 15 and into the grooves 13 situated on the face 11*a* of the cylinder mantle 11. The transfer of negative pressure $P_1$ is most efficient when the number of holes 15 is maximized. However, an upper limit is imposed on the number of holes by the air flow Q into the interior space 14 in the cylinder 10. The desired optimum value is attained by choosing the required negative pressure $P_1$ and by choosing the total cross-sectional flow area of the holes 15 such that the flow into the interior 14 of the cylinder 10 is limited and remains within certain low limits, in spite of minor variations in the negative pressure $P_1$.

Figure 3:
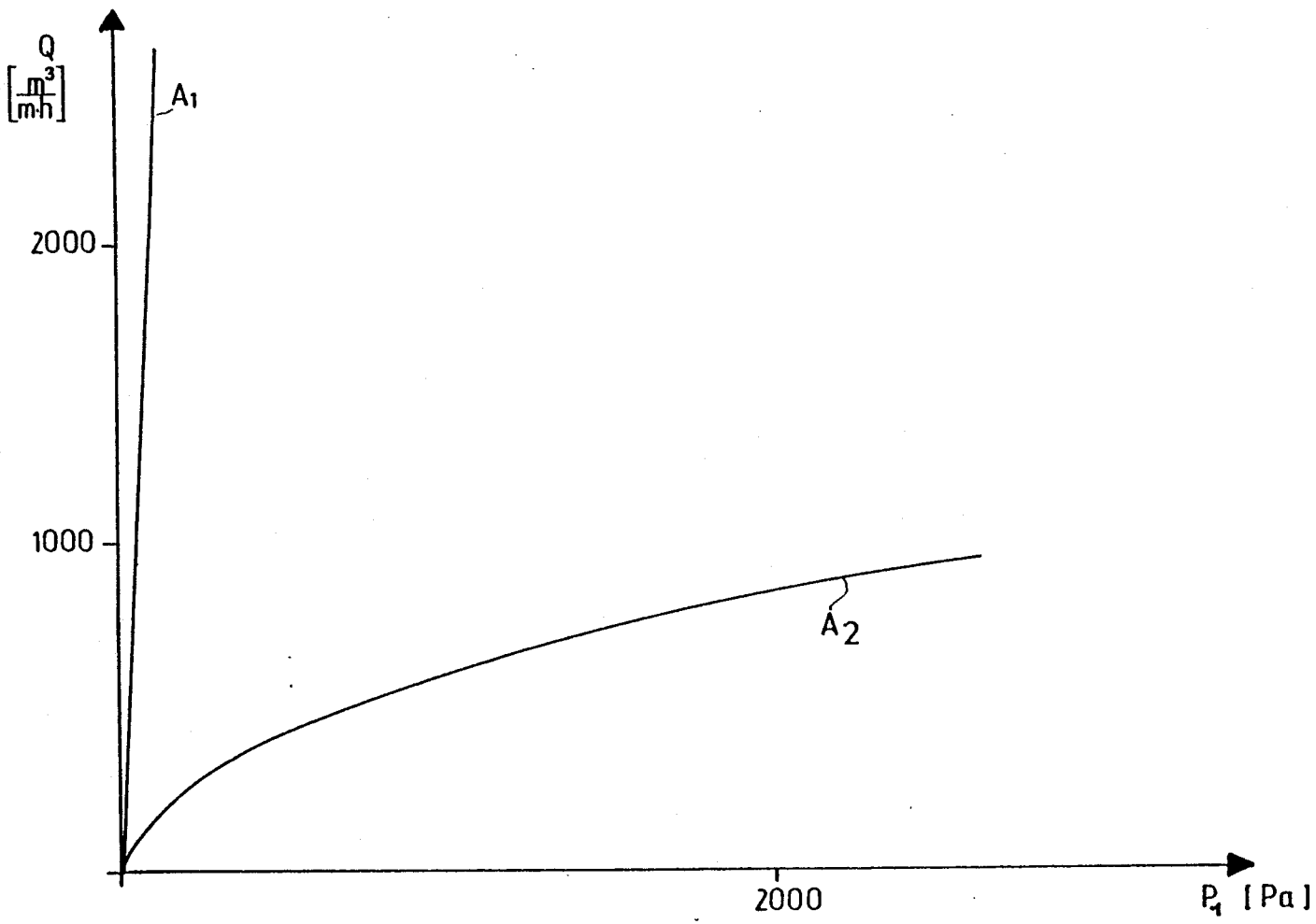
FIG. 3 is a graphic presentation of relationship between negative pressure prevailing in a space of negative pressure within a cylinder in accordance with the present invention, and flow taking place through holes in a mantle of the invention roll as a function of chosen total cross-sectional flow area of these holes.

FIG. 3 is a graphic presentation in which the horizontal coordinates represent the negative pressure $P_1$ inside the cylinder 10 and the vertical coordinates represent the flow of air Q into the cylinder 10 through the bores 15 or equivalent. The curves are shown for two chosen total cross-sectional flow areas $A_2$ and $A_1'$ of the holes 15. If the total cross-sectional flow area is large, i.e. if the number of holes 15 is high and/or if the hole area is large, then the flow passing through the holes 15 also steeply increases when the negative pressure $P_1$ into the space 14 is increased. As abundance of air ($L_1$) flows thereat from the upper side face of the drying cylinder 10 and into the inner space, i.e. space 14 of negative pressure within the cylinder 10. This case is illustrated by curve $A_1'$ in FIG. 3. The curve $A_1'$ principally corresponds to the characteristic curve of the suction roll.

To the contrary, if the number of holes 15 is lower and/or the cross-sectional area of these holes 15 has been chosen correctly, i.e. the total cross-sectional flow area $A_2$ is considerably smaller than $A_1'$, then the form of the curve is different. In such a case, the curve includes an almost horizontal part as illustrated in FIG. 3. From this curve portion, it can be seen that the negative pressure $P_1$ can be chosen within a wide range of variation while the flow Q, nevertheless, remains low and within controlled limits. Under these circumstances the total number of the suction holes 15 and their total area must be in a certain relationship to the desired level of negative pressure.

For example, if the roll diameter is 1500 mm and the roll length is 9300 mm, and the grooves are base or width b=5, height h=4, and spacing between grooves 13 t=20, then the total number of grooves is 455 pcs. This value is calculated as follows. The width of the roll is 9300 mm. The grooves 13 are naturally located only in the area where there is a paper web. In other words there is a 100 mm margin from each end face of the roll 10 to the first groove (more specifically to the center of the groove). Therefore, according to the following formula (9300 mm−2×100 mm)/t(mm)=455 grooves, where t=20 mm=the spacing between the grooves 13.

The perforation is carried out as follows. The number of holes per groove is chosen as 30 pcs., i.e. the spacing of the holes is 12°, or on the face of the roll mantle about 157 mm. In the area of threading, the holes 15 are made into each groove 13. The holes 15 are made into every second groove 13 at the rear edge of the cylinder 10, and into every fourth groove in a middle area of the cylinder 10. The total number of holes is 3960 pcs., while the diameter d of each hole 15 is chosen as 4.5 mm. The total cross-sectional area of the holes 15 thereat is 630 $cm^2$. The desired negative pressure is 120 mm $H_2O$.

From the formulas $Q=\mu\times A_o\times v$ and $$v=\sqrt{\frac{2gh}{\gamma}},$$

the velocity of the air flow is obtained as v=45.5 m/s and Q as Q=2 $m^3$/s. The frictional resistance in the hole 15 is about 40 mm $H_2O$. In other words, to maintain a negative pressure of 120 mm $H_2O$, at the maximum a suction quantity of 800 $m^3$ per hour and per meter of length of the roll is required, i.e. a total of 7200 $m^3$ per hour. It should be noted that the web W and the wire H partially seal the roll 10, whereby the air quantity is reduced and/or the suction becomes deeper. If it is presumed that, in the suction shaft 18*a* of the present example, the air velocity is v=35 m/s, then the inner diameter of the shaft 18*a* is obtained as 270 mm. When $\Delta P$=40 mm $H_2O$ is reserved for the exhaust losses, then the pressure in the blower is P=200 mm $H_2O$ and the power requirement of the blower is $$Po=\frac{Q\times p}{102\ (\mathrm{kW})}=4\ \mathrm{kW}.$$

The following values were used in the accompanying formulas:

g=acceleration of gravity
h=difference in pressure, mm $H_2O$
v=velocity m/s
$\gamma$=1.128 kg/$m^3$ (+40° C.)
$A_o$=air flow area $m^2$
$\mu$=throttle factor 0.7
d=diameter of each hole
Friction resistance in the hole $$\Delta p=\frac{\lambda\cdot 1\cdot v^2\cdot\gamma}{d\cdot 2g}\ \text{and}$$

$\lambda$=0.05 (according to Bradke), and
d=diameter of each hole

By means of the example presented above, it has been possible to establish the suitability of the invention device in practice. A combination of a groove 13 and hole 15 pattern of low density is advantageous to manufacture, because the total number of holes 15 is only a small portion of the corresponding number of holes in a suction roll proper.

In the present invention, in at least one end of the cylinder 10, the perforation may be made denser than in other areas of the cylinder 10. For example, in this end of the cylinder 10, the perforation may be made into every groove 13, while in the other areas of the cylinder 10, the perforation is not made into each and every groove. In the middle area of the cylinder 10, the perforations may be made into every second or every third groove.

By the same token, the internal structures required by a suction roll are completely omitted in the leading cylinders 10 of the invention herein. Also, in the absence of external box constructions, the initial end of the drying section of the paper machine can be monitored and readily serviced. The masses of air to be dealt with are linked in the overall air-conditioning of the paper machine.

Figure 4:
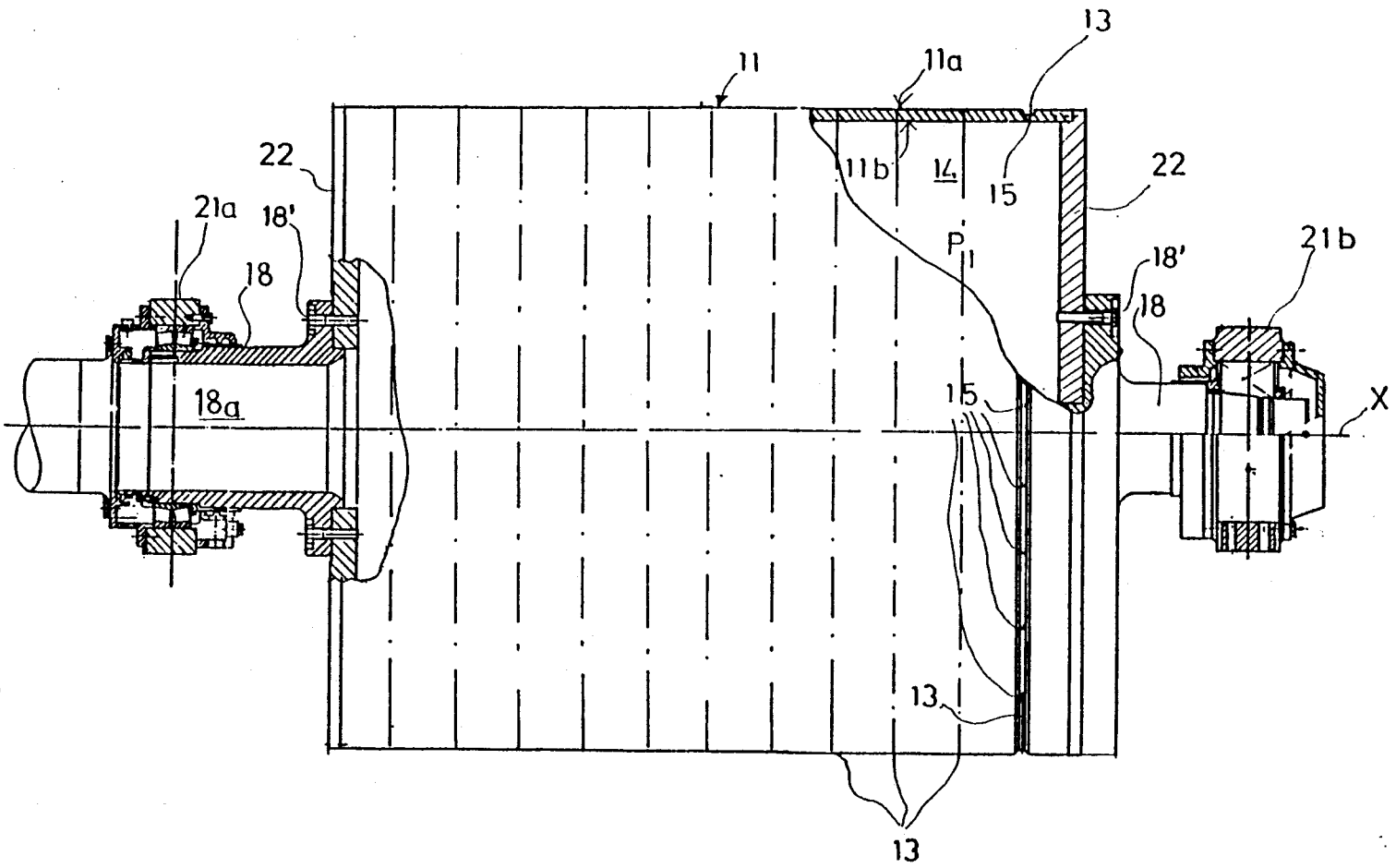
FIG. 4 is a partially sectional side view of a cylinder in accordance with the present invention.

FIG. 4 illustrates a construction of a cylinder in accordance with the present invention. The cylinder 10 comprises a mantle 11 and grooves 13 on the mantle 11. One groove 13 is illustrated in the figure for exemplary purposes. The grooves 13 are provided side-by-side across the entire mantle face 11*a* of the cylinder 10. The other grooves 13 are represented in FIG. 4 by means of dashed-dotted lines. The negative pressure $P_1$ is introduced through the hollow interior space 18*a* in the shaft 18 at the service side $H_p$ and into the interior space 14 of negative pressure within the cylinder 10. The shaft 18 is attached by means of screws 18' to the flange 22. The shaft 18 is fitted to revolve on bearings 21*a* and 21*b*.

FIG. 5 is a schematic representation of ratio of the area of the perforations 15 to the area of the perforated grooves 13. The ratio of the total cross-sectional flow area $A_0$ of the holes 15 in the cylinder to the total cross-sectional flow area $A_1$ of the perforated grooves 13 is within the range of about 1:110 to 1:150, most advantageously within the range of about 1:50 to 1:110.

Advantageously, the flow Q per meter of width of the cylinder 10 into the space 14 of negative pressure in the cylinder 10, is within the range of about 500 $m^3$/m.h. to 1500 $m^3$/m.h., most advantageously within the range of about 800 $m^3$/m.h. to 1200 $m^3$/m.h. The negative pressure $P_1$ in the interior space 14 in the cylinder 10 is advantageously within the range of about 1000 Pa to 3000 Pa. The ratio of the total cross-sectional flow area $A_0$ of the holes 15 to the entire outside mantle area of the cylinder 10 mantle 11, is within the range of about 1 to 2 per mill, and preferably within the area of about 1.5 per mill.

The preceding description of the present invention is merely exemplary, and is not intended to limit the scope thereof in any way.

What is claimed is:

1. Method for guiding a web through a group of drying cylinders having at least one heated cylinder and having at least one leading cylinder or roll, with the web being passed around the cylinders, comprising the steps of providing the leading cylinder or roll with holes passing through a mantle thereof and fitting the holes in the mantle to open at one end into an interior space within the cylinder or roll mantle and at an opposite end into grooves provided upon an outer face of the mantle, and applying a negative or suction pressure to an inner face of the mantle to generate free flow of air into the cylinder or roll interior from an outer area surrounding the mantle through the holes, whereby the negative or suction pressure is transmitted from inside the roll or cylinder to the grooves provided in the outer mantle face and a adhesion force is applied to the web through the grooves.

2. The method of claim 1, wherein the group of drying cylinders is situated in a multi-cylinder drying section of the paper machine and comprises a single-wire draw, whereby the web is pressed by a drying wire against a face of the at least one heated cylinder and runs outside the drying wire about the at least one leading cylinder.

3. The method of claim 2, wherein the at least one heated cylinder is heated by steam, the drying wire is a felt, and the leading cylinder is a lower cylinder in the group of drying cylinders.

4. The method of claim 1, comprising the additional step of introducing the negative or suction pressure into the interior of the leading cylinder or roll along a suction duct communicating with the cylinder or roll interior, whereby the negative or suction pressure is applied to substantially the entire inner face of the roll or cylinder mantle.

5. Device for guiding a web through a group of drying cylinders having at least one heated cylinder and at least one leading cylinder or roll, with the web being passed around the cylinders, comprising the leading cylinder or roll being provided with holes passing through a mantle thereof and being fitted in the mantle to open at one end into an interior space within the cylinder or roll mantle and at an opposite end into grooves provided upon an outer face of the mantle, and means for applying negative or suction pressure in the cylinder or roll interior, to generate free flow of air through said holes in the mantle and into the interior space, whereby the negative or suction pressure is applied along an inner face of the cylinder or roll mantle and is transferred from inside the roll or cylinder to the grooves, and an adhesion force is applied to the web through the grooves.

6. The combination of claim 5, wherein the group of cylinders is situated in a multi-cylinder dryer section of a paper machine comprising a single-wire draw having a drying wire arranged to press the web against a face of the heated cylinder and to pass the web outside of the drying wire and around the leading cylinder, and wherein said means comprise a suction duct communicating with the interior of the cylinder or roll.

7. The combination of claim 6, wherein the at least one heated cylinder is heated by steam, and the at least one leading cylinder or roll is a lower cylinder in the group of drying cylinders, whereby the free flow of air is generated from an upper part of the leading cylinder or roll and from an area in which the wire and web are not pressed against the outer mantle face.

8. A paper machine cylinder comprising shafts on which the cylinder is mounted to revolve by means of bearings, end flanges to which said shafts are respectively coupled, a mantle connected to said flanges at ends thereof and comprising grooves on an outer face thereof, wherein said cylinder comprises holes passing through the mantle and opening, at one end thereof, into said grooves and at an opposite end thereof, into an inner space within the mantle, a source of negative or suction pressure, and a suction duct passing into the interior space of the cylinder or roll from said source and transmitting the negative or suction pressure thereof, whereby the negative or suction pressure is applied to substantially the entire inner face of the mantle.

9. A paper machine cylinder comprising shafts on which the cylinder is mounted to revolve by means of bearings, end flanges to which said shafts are respectively coupled, a mantle connected to said flanges at ends thereof and comprising grooves on an outer face thereof, wherein said cylinder comprises holes passing through the mantle and opening, at one end thereof, into said grooves and at an opposite end thereof, into an inner space within the mantle, wherein one of said shafts is hollow and has a hollow interior space through which suction pressure is applied to the interior space of the cylinder or roll.

10. The combination of claim 8, wherein a negative or suction pressure within a range of about 1000 Pa to 3000 Pa is applied.

* * * * *